US005942840A

United States Patent [19]

Steere et al.

[11] Patent Number: 5,942,840

[45] Date of Patent: Aug. 24, 1999

[54] HIGH-PRESSURE DISCHARGE LAMP WITH SEALED UV-ENHANCER

[75] Inventors: Tom G. Steere, Hornell; Raghu Ramaiah; Greg Nelson, both of Painted Post; Jay J. Palmer, Bath; John C. Alderman, Corning, all of N.Y.

[73] Assignee: Philips Electronics North America Corp., New York, N.Y.

[21] Appl. No.: 08/844,914

[22] Filed: Apr. 22, 1997

[51] Int. Cl.[6] ..... H01J 1/02

[52] U.S. Cl. ..... 313/25; 313/573; 313/634

[58] Field of Search ..... 313/25, 570, 573, 313/634, 601

[56] References Cited

U.S. PATENT DOCUMENTS 4,818,915 4/1989 Zaslavsky et al. ..... 315/60

FOREIGN PATENT DOCUMENTS

WO9802902 1/1998 WIPO .

*Primary Examiner*—Vip Patel
*Attorney, Agent, or Firm*—Walter M. Egbert

[57] ABSTRACT

A high-pressure discharge lamp is disclosed having a discharge vessel, an outer bulb enclosing said discharge vessel and defining an intervening space therebetween, a UV-enhancer positioned in the space between the outer bulb and the discharge vessel, the UV-enhancer provided with a wall fabricated of a ceramic material and an internal electrode, wherein an end portion of the UV-enhancer is closed with a compressive seal.

9 Claims, 2 Drawing Sheets

HIGH-PRESSURE DISCHARGE LAMP WITH SEALED UV-ENHANCER

BACKGROUND OF THE INVENTION

1. Technical Field

This invention relates to high-pressure discharge lamps having a discharge vessel enclosed by an outer bulb provided with a lamp cap, and more particularly to a lamp having a starting aid arranged in the intervening space between the outer bulb and the discharge vessel.

2. Description of the Related Art

High pressure discharge lamps, or more particularly metal halide lamps, having starting aids are known in the art. Such lamps are suitable for various applications such as general interior lighting, general exterior lighting, video illumination, etc. The discharge vessel of the known lamp is typically made of quartz glass. Alternatively, this vessel may be made of a ceramic material. Ceramic material in the present description and claims is understood to be a densely sintered polycrystalline metal oxide such as, for example, $Al_2O_3$ or YAG and densely sintered polycrystalline metal nitride such as, for example, AlN.

A known problem of metal halide lamps is the comparatively wide spread in ignition time. This problem arises from a shortage of free electrons due to the presence of electronegative iodine in the lamp filling. Several methods are known in the art to counteract this problem. For example, the addition of a small quantity of $^{85}Kr$ in the discharge vessel can supplement such a shortage. A disadvantage of $^{85}Kr$ as a filling material is its radioactive characteristics.

Alternatively, ignition aids, such as a UV-enhancer, are used in metal halide lamps to promote ignition. A UV-enhancer is typically a small discharge tube positioned adjacent the discharge vessel that acts as an ultraviolet radiation source. Such a UV-enhancer has been disclosed in U.S. Pat. No. 4,818,915 to Zaslavsky et al. This UV-enhancer has an envelope of UV-transmitting quartz material. Upon breakdown, the UV-enhancer will generate UV-radiation at about 253.7 nm or less. The influence of this UV-radiation leads to the production of free electrons in the discharge vessel, which in their turn strongly promote lamp ignition.

The use of the quartz UV-enhancer in the known lamp leads to an improvement in situations where ignition voltage pulses of the order of 5 kV are useful and admissible. Under many circumstances occurring in practice, however, it is desirable or even required that the ignition voltage pulses should not substantially exceed a level of 3 kV. In addition, the manufacture and dosing of such UV-enhancers is complex and expensive.

Another starting aid is known from commonly-assigned U.S. Pat. No. 5,811,933 to van de Niewenhuizen et al. The lamp disclosed therein is characterized in that the wall of the UV-enhancer is made from ceramic material. The probability of breakdown upon the application of an ignition pulse rises strongly both in the UV-enhancer and in the discharge vessel owing to the presence of the ceramic material in the wall of the enhancer. The increased breakdown probability manifests itself in a drop in the minimum ignition pulse value required for a reliable lamp ignition.

The use of the UV-enhancer as disclosed in the above lamp leads to an improvement in ignition characteristics. However, the manufacture of the completed ceramic enhancer itself may require the use of costly parts and materials as well as additional manufacturing steps. In the lamp disclosed above, the UV-enhancer is constructed from ceramic material which has been extruded into hollow cylinders and sintered to achieve the necessary translucency and gas-tight characteristics. As compared to quartz, the ceramic material cannot be softened and reworked after sintering. The resulting open end portions of the cylindrical sections must be sealed to contain the filling. Consequently, an additional part, i.e. an end plug would be needed. An additional manufacturing (or process) step is required to seal the end of the enhancer tube. It is therefore desirable to improve the operation and manufacture of the lamp by reducing the material and manufacturing steps necessary.

It desirable to use the UV-enhancer in smaller lamp applications. However, a construction that requires smaller multiple individual pieces makes such miniaturization difficult. It is therefore desirable from this point of view to provide a starting aid having simplified construction.

The integrity of the seals is critical to the efficacy and lifetime characteristics of the UV-enhancer and the lamp in general. The use of different materials having different thermal expansion and durability characteristics may detract from the operation of the lamp. It is therefore desirable to improve the integrity of the seals by simplified construction.

SUMMARY

The invention has for its object to provide a measure by which the above problems are counteracted. A unique high-pressure discharge lamp is disclosed having a discharge vessel, an outer bulb enclosing said discharge vessel and defining an intervening space therebetween, a UV-enhancer positioned in the space between the outer bulb and the discharge vessel, the UV-enhancer provided with a wall fabricated of a ceramic material and an internal electrode, wherein an end portion of the UV-enhancer is closed with a compressive seal. The high pressure discharge lamp is preferably a metal halide lamp with a discharge vessel containing a rare gas, mercury, and a metal halide. The ceramic wall of the UV-enhancer may be made from densely sintered polycrystalline $Al_2O_3$.

In a preferred embodiment, the compressive seal is positioned at an end portion of the UV-enhancer remote from the internal electrode.

In yet another preferred embodiment, the compressive seal is positioned at an end portion of the UV-enhancer adjacent the the electrode.

The UV-enhancer may have a rare gas filling. In a preferred embodiment, the rare gas filling is argon. The filling pressure of the rare gas filling lies between 30 mbar and 200 mbar.

A method of manufacturing a high pressure discharge lamp is disclosed, having the steps of providing a discharge vessel having an ionizable filling and a pair of electrical conductors each having a first end sealed within the discharge vessel, a lamp cap, and an electrical connection between a second end of each said electrical conductors and said lamp cap. A hollow section of ceramic material is extruded. A first end portion of the hollow section is sealed, and the hollow section is heated to a hardened state. An electrode is inserted into the hollow section, and a second end portion of the hollow section is sealed with an ionizable filling therein to form a UV-enhancer. An electrical connection is provided from said electrode to said electrical conductor, and said discharge vessel, said UV-enhancer, and a portion of said electrical conductors are enclosed within an outer bulb.

It is an object of the invention to provide a lamp having a UV-enhancer that requires fewer components and materials.

It is an object of the invention to provide a lamp having a UV-enhancer having a seal with a high degree of integrity.

These and other features of the lamp according to the invention will become more readily apparent to those skilled in the art from the following detailed description of the subject: disclosure.

BRIEF DESCRIPTION OF THE DRAWINGS

Various embodiments of the subject lamp are explained in more detail with reference to the drawings (not true to scale), wherein.

DETAILED DESCRIPTION OF PREFERRED EMBODIMENTS

Figure 1:
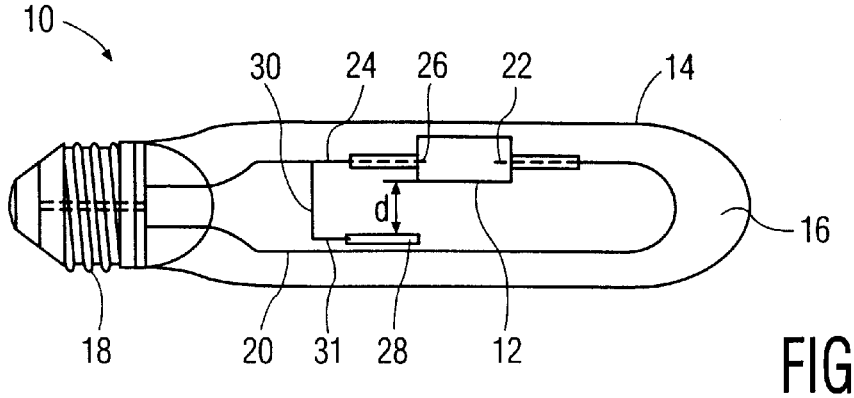
FIG. 1 is a side elevation of a lamp according to the invention.

FIG. 1 illustrates a preferred embodiment of a high-pressure discharge lamp of the subject disclosure, designated generally by reference numeral 10. Lamp 10 has a discharge vessel 12 which is enclosed by an outer bulb 14 defining an intervening space 16 therebetween. Discharge vessel 12 contains an ionizable filling such as mercury and metal halides as is well known in the art. Lamp 10 further has a lamp cap 18 positioned at an end of outer bulb 14. A first current supply conductor 20 forms an electrical connection between lamp cap 18 and internal electrode 22 of discharge vessel 12. Likewise, second current supply conductor 24 forms an electrical connection between lamp cap 18 and internal electrode 26 of discharge vessel 12.

UV-enhancer 28 is positioned in the intervening space 16 between outer bulb 14 and discharge vessel 22. A lead-through conductor 30 is connected at one end to current supply conductor 24, and at a second end to electrode 31 of UV-enhancer 28. It is contemplated that electrode 31 and lead-through conductor 30 are fabricated as a single, integral member. UV-enhancer 28 is positioned relative to current supply conductor 20 such that capacitive coupling is achieved therebetween.

Figure 2:
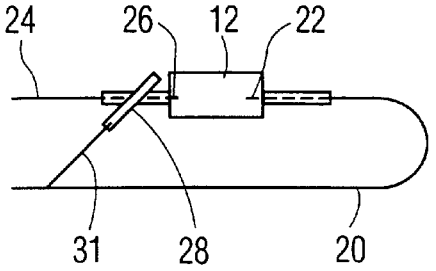
FIG. 2 diagrammatically shows a positioning of the UV-enhancer relative to a discharge vessel of the lamp.

The UV-enhancer 28 should be positioned at a very small distance from the discharge vessel to promote a fast and reliable ignition of the lamp according to the invention. This is possible in the manner as shown in FIG. 1, for example, where the UV-enhancer is positioned parallel to and at a distance d from the discharge vessel. Preferably, the distance d in such an arrangement is at most 10 mm. Another favorable positioning of the UV-enhancer is behind an electrode adjacent the lead-through conductor at an angle (of e.g. 45°) to the longitudinal axis of the discharge vessel, as depicted diagrammatically in FIG. 2. Positioning the UV-enhancer at such a small distance from the discharge vessel requires a very good heat resistance of the wall of the UV-enhancer. The wall temperature of the UV-enhancer will lie above 600° C. for prolonged periods during lamp operation, in particular if the lamp has a ceramic discharge vessel.

Figure 3:
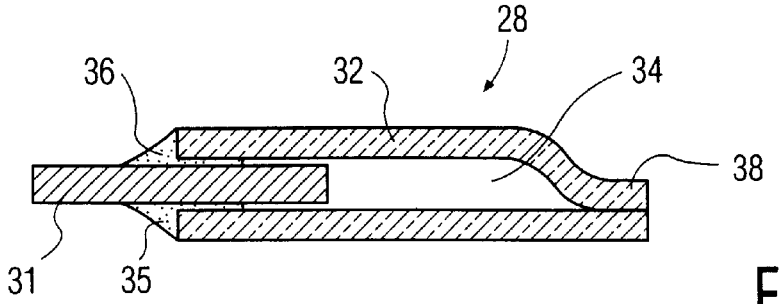
FIG. 3 is a cross-sectional view of a UV-enhancer of the lamp of FIG. 1 in detail.

FIG. 3 illustrates UV-enhancer 28 in greater detail. UV-enhancer 28 has a wall 32 which encloses a cavity 34, defining a discharge space for UV-enhancer 28, as will be described below. End portion 33 of wall 32 is configured for reception of electrode 31 into gas-tight cavity 34. Electrode 31 is provided within cavity 34. A gas tight seal is formed around electrode 31 adjacent end portion 33. In a preferred embodiment, electrode 31 is fabricated from Nb. It is alternatively contemplated to fabricate electrode 31 as a Nb-rod, with a W end-portion within cavity 34.

Wall 32 of UV-enhancer 28 is made of ceramic material. In a preferred embodiment of UV-enhancer 28, wall 32 is made from densely sintered polycrystalline $Al_2O_3$. The wall 32 is preferably constructed from a single cylindrical piece of this ceramic material having a compressive seal 38 at an end portion thereof. Such compressive seal 38 encompasses any pinch, crimp, or fusing of the wall 6 that results in a gas-tight junction of the ceramic material. Preferably, no additional end caps or sealing materials are used at this seal 38. Preferably, the compressive seal 38 is applied while the ceramic material in the "green" state prior to sintering or other heat treating or hardening process? In the preferred embodiment, the seal is positioned at the end porion remote from the internal electrode 31.

Although it was found that a combination of a rare gas and Hg is suitable as a filling, the UV-enhancer preferably has a rare gas filling within cavity 34. Suitable is inter alia Ne. Ar was found to be particularly suitable as a filling. A pressure is preferably chosen for the filling which accompanies a minimum breakdown voltage. This filling pressure may be readily ascertained experimentally. A fair approximation can be realized by means of the Paschen curve, as is well known in the art. A mixture of rare gases in the form of a Penning mixture is also suitable.

A major advantage of a rare gas filling is that not only the use of radioactive substances ($^{85}Kr$) but also that of heavy metal (Hg) is eliminated in the manufacture of the UV-enhancer. Surprisingly, free electrons are generated in such quantities upon breakdown in a rare gas filling that lamp ignition is strongly promoted.

According to a preferred embodiment, the UV-enhancer 28 has an external length of 25 mm, an external diameter of 2.6 mm, an internal diameter of 0.78 mm, and a greatest internal length of 4 mm. The Nb electrode 31 has a diameter of 71 mm. The UV-enhancer contains Ar with a filling pressure of 133.5. Preferably, the filling pressure lies between 30 mbar and 1200 mbar. For comparison, it should be noted that commercially available UV-enhancers with a quartz or quartz-glass wall have an external length of 25 mm and a diameter of 5 mm.

It is contemplated that the UV-enhancer 28 may be manufactured under one of several methods. The ceramic material is extruded into a cylindrical section having a typical length of 30 inches. The ceramic material is considered to be in the "green" state during such extrusion. The extruded ceramic section is crimped, pinched, joined together at various points along its length. The spacing of the crimps corresponds to approximately twice the length of the UV-enhancer. The section is then cut at the location of each crimp or pinch. Thus, several sections are produced having a length twice the required length of the UV-enhancer, and a crimp at both ends. These sections are then pre-sintered to a temperature above 1200° C. to increase the density of the material and burn out the binder material, such as methyl cellulose.

Each section is subsequently cut in half, for example by a diamond saw, thereby producing two enhancers having a seal at a first end portion and an open second end portion. The enhancers are then tumbled in water for a specified time to wash the dust out of the inner cavity. Subsequently, the enhancers are allowed to dry. The enhancers are then loaded into the high temperature sintering oven (at 1850° C. ) and sintered to translucency.

After sintering, electrodes 31 are inserted in the enhancer 28. For example, niobium wire is crimped to the desired length and inserted into the enhancer. A frit ring 36 is placed over the electrode 31 and resting on the end face 33 of the enhancer 28. An assembly consisting of the enhancer 28, electrode 31, and frit ring 36 is placed on a holder assembly and inserted into a high temperature oven (1400° C.) The oven is pressurized with Ar just prior to achieving the sealing temperature in which the frit ring 36 is melted to create a gas-tight seal between the electrode 31 and the enhancer wall 32. Thus the Ar may be sealed into the enhancer cavity 34, at an approximate pressure of (33 mbar). Alternatively, it is contemplated that the enhancer 28 can be filled by other rare gases, such as Ne. In yet another embodiment, a combination of a rare gas and Hg may be used as a filling in the enhancer, although Hg is not necessary for the enhancer to serve as a starting aid, as described above.

A series of lamps was subjected to an ignition test. The lamps are 70 Watt CDM lamps, connected to a supply voltage source of 120 V, Hz via a stabilizer ballast provided with an igniter circuit. These lamps have ceramic discharge vessels with fillings comprising metal halide. The ceramic material of the discharge vessel reaches a temperature of between 800° C. and 1000° C. during lamp operation. The igniter circuit comprises a Velonex pulse generator. This starter is widely used for testing the ignition of high-pressure discharge lamps and supplies ignition pulses with a range of pulse heights and widths.

A number of lamps from the series was provided with a ceramic UV-enhancer of the embodiment described above. Another group of the lamps was provided with the known quartz UV-enhancer with a filling of Ar and Hg.

Figure 4:
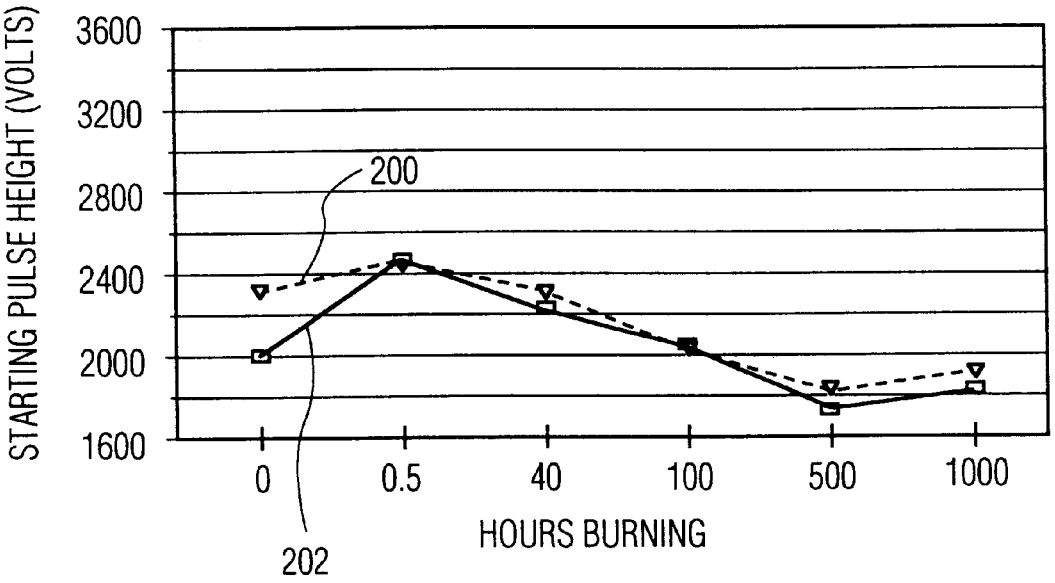
FIG. 4 is plot illustrating the average starting pulses for the known lamp and the lamp in accordance with the subject: invention.
Figure 5:
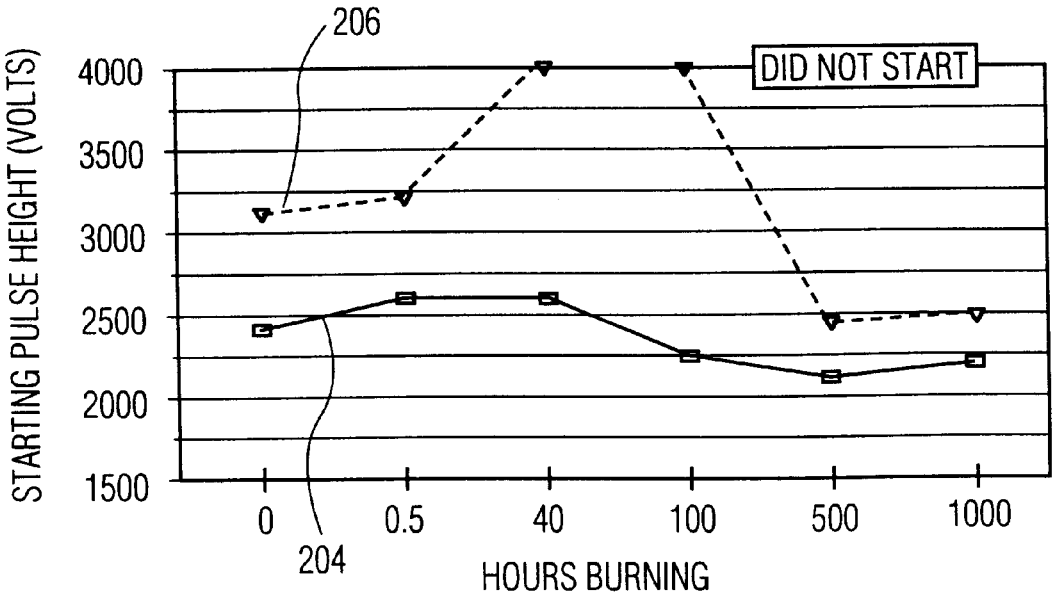
FIG. 5 is plot illustrating the maximum starting pulses for the known lamp and the lamp in accordance with the subject: invention.

The test results are illustrated in FIGS. 4 and 5. The average starting voltages are shown in FIG. 4. The average starting voltages 200 (inverted triangle) of the quartz enhancer are comparable to the average starting voltage 202 of the ceramic UV-enhancer of the subject invention. However, the maximum starting voltages, as represented in FIG. 5, indicate a much greater spread in the starting voltages for the known quartz enhancer. The maximum starting voltage 204 for the ceramic UV-enhancer of the subject invention is approximately 500 volts lower than the maximum starting voltage 206 of the known quartz enhancer. Furthermore, one of the known quartz enhancers failed to start a lamp at 40 hours of burning, as did one the known quartz enhancers at 100 hours.

Figure 3A:
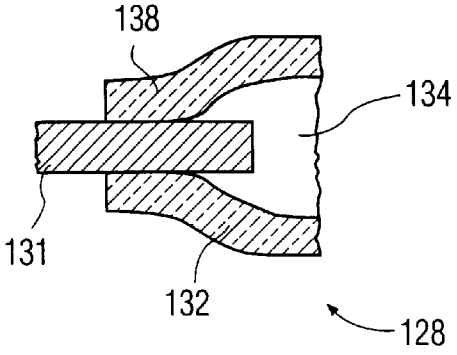
FIG. 3*a* is a cross-sectional view of a UV-enhancer in accordance with an alternative embodiment of the subject invention.

UV-enhancer 128, as disclosed in an alternative embodiment of the invention, may be provided with a compressive seal adjacent electrode 131, as illustrated in FIG. 3*a*. The ceramic material is extruded substantially as described above with respect to UV-enhancer 28. According to this embodiment, the electrode 131 is inserted adjacent to one end portion of the enhancer 128 when the ceramic material is in the "green" state. A crimp or pinch is applied to the ceramic material to create a seal between the ceramic wall 132 and the electrode 131. The UV-enhancer 128 and electrode 131 are sintered substantially as described above to create a gas-tight compressive seal 138. With such a construction, no further parts or sealing materials would be necessary.

It will be understood that various modifications may be made to the embodiments shown herein. Therefore, the above description should not be construed as limiting, but merely as exemplifications as preferred embodiments. Those skilled in the art will envision other modifications within the scope and spirit of the claims appended hereto.

What is claimed is:

1. A high-pressure discharge lamp which comprises:

(a) a discharge vessel;

(b) an outer bulb enclosing said discharge vessel and defining an intervening space therebetween;

(c) a UV-enhancer positioned in the space between the outer bulb and the discharge vessel, the UV-enhancer provided with a wall fabricated of a ceramic material and an internal electrode, wherein an end portion of the UV-enhancer is closed with a compressive seal.

2. A high-pressure discharge lamp as recited in claim 1, wherein the compressive seal is positioned at an end portion of the UV-enhancer remote from the internal electrode.

3. A high-pressure discharge lamp as recited in claim 1, wherein the compressive seal is positioned at an end portion of the UV-enhancer adjacent the internal electrode.

4. A high-pressure discharge lamp as recited in claim 2, wherein the wall of the UV-enhancer is made from densely sintered polycrystalline $Al_2O_3$.

5. A lamp as recited in claim 4, wherein the UV-enhancer has a rare gas filling.

6. A lamp as recited in claim 5, wherein the rare gas filling is argon.

7. A lamp as claimed in claim 6, wherein the filling pressure of the rare gas filling lies between 30 mbar and 1200 mbar.

8. A high-pressure metal-halide lamp which comprises:

(a) a discharge vessel containing mercury, a metal halide, and a rare gas;

(b) an outer bulb enclosing said discharge vessel and defining an intervening space therebetween;

(c) a UV-enhancer positioned in the space between the outer bulb and the discharge vessel, the UV-enhancer provided with a wall fabricated of a ceramic material and an internal electrode, wherein an end portion of the UV-enhancer is closed with a compressive seal.

9. A method of manufacturing a high pressure discharge lamp, comprising the steps of:

a) providing a discharge vessel having an ionizable filling and a pair of electrical conductors each having a first end sealed within the discharge vessel, a lamp cap, and an electrical connection between a second end of each said electrical conductors and said lamp cap;

b) extruding a hollow section of ceramic material;

c) sealing a first end portion of the hollow section;

d) heating the hollow section to a hardened state;

e) inserting an electrode into the hollow section;

f) sealing a second end portion of the hollow section with an ionizable filling therein to form a UV-enhancer;

g) providing an electrical connection from said electrode to said electrical conductor; and h) enclosing said discharge vessel, said UV-enhancer, and a portion of said electrical conductors within an outer bulb.

* * * * *